US006902515B2

(12) United States Patent
Howell et al.

(10) Patent No.: US 6,902,515 B2
(45) Date of Patent: Jun. 7, 2005

(54) MULTI-FUNCTIONAL EXERCISE APPARATUS

(76) Inventors: Norman L. Howell, 30701 Sloan Canyon Rd., Castaic, CA (US) 91384; Steven R. Burke, 9391 Westcliff Dr., Huntington Beach, CA (US) 92646; Paul T. Wilkins, 1902 Derby Dr., Santa Ana, CA (US) 92705

( * ) Notice: Subject to any disclaimer, the term of this patent is extended or adjusted under 35 U.S.C. 154(b) by 37 days.

(21) Appl. No.: 10/407,688

(22) Filed: Apr. 4, 2003

(65) Prior Publication Data

US 2004/0198563 A1 Oct. 7, 2004

(51) Int. Cl.[7] ..... A63B 22/12
(52) U.S. Cl. ..... 482/62; 482/57
(58) Field of Search ..... 482/51–53, 57, 482/62, 93, 121–123, 127, 138, 139, 148, 132–136, 907, 908

(56) References Cited

U.S. PATENT DOCUMENTS

| | | | | | |
|---|---|---|---|---|---|
| 4,296,924 | A | * | 10/1981 | Anzaldua et al. | 482/139 |
| 4,757,992 | A | * | 7/1988 | Heitsch et al. | 482/136 |
| 5,035,418 | A | * | 7/1991 | Harabayashi | 482/62 |
| D320,826 | S | | 10/1991 | Hildebrandt et al. | |
| D324,090 | S | | 2/1992 | Miller | |
| D330,237 | S | | 10/1992 | Miller | |
| D340,758 | S | | 10/1993 | Ueda | |
| D342,299 | S | | 12/1993 | Birrell et al. | |
| D353,422 | S | | 12/1994 | Bostic et al. | |
| D362,699 | S | | 9/1995 | Heaton et al. | |
| 5,584,700 | A | | 12/1996 | Feldman et al. | |
| 5,595,557 | A | * | 1/1997 | Lambert et al. | 482/57 |
| 5,609,566 | A | * | 3/1997 | Pupovic | 601/23 |
| 5,707,322 | A | | 1/1998 | Dreissigacker et al. | |
| 5,931,765 | A | * | 8/1999 | Huang | 482/57 |
| 6,001,046 | A | | 12/1999 | Chang | |
| 6,004,243 | A | | 12/1999 | Ewert | |
| 6,080,088 | A | * | 6/2000 | Petersen et al. | 482/72 |
| 6,113,522 | A | * | 9/2000 | Fontenot et al. | 482/111 |
| 6,132,341 | A | * | 10/2000 | Lin | 482/57 |
| 6,142,913 | A | | 11/2000 | Ewert | |
| 6,174,270 | B1 | * | 1/2001 | Dagenais | 482/148 |
| 6,231,485 | B1 | | 5/2001 | Dreissigacker et al. | |
| 6,248,047 | B1 | * | 6/2001 | Abdo | 482/130 |
| 6,306,108 | B1 | * | 10/2001 | Butler | 601/36 |
| 6,726,608 | B1 | * | 4/2004 | Hsu | 482/130 |
| 2004/0097351 | A1 | * | 5/2004 | Tornabene | |

* cited by examiner

*Primary Examiner*—Justine R. Yu
*Assistant Examiner*—Tam Nguyen
(74) *Attorney, Agent, or Firm*—Stetina Brunda Garred & Brucket

(57) ABSTRACT

A multi-functional exercise apparatus for exercising arms, shoulders and trunk of a user. This exercise apparatus may include a stationary bicycle support platform and includes an upper body assembly which is movably engaged to and extended about the bicycle's seat mount. An arm-shoulder device is movably engaged to the upper body assembly. By providing such exercise apparatus, a user can move the upper body assembly with respect to the bicycle's seat mount to exercise the user's trunk while moving the arm-shoulder device to exercise the arms and shoulders. The user can independently or simultaneously rotate the bicycle's foot pedals with the user's legs to exercise the same for a more complete workout.

5 Claims, 4 Drawing Sheets

MULTI-FUNCTIONAL EXERCISE APPARATUS

CROSS-REFERENCE TO RELATED APPLICATIONS (Not Applicable)

STATEMENT RE: FEDERALLY SPONSORED RESEARCH/DEVELOPMENT (Not Applicable)

BACKGROUND OF THE INVENTION

The present invention relates generally to exercise apparatus, and more particularly to an improved, multi-functional exercise apparatus which integrates the use of a multi-pivotal upper body assembly and a rotational arm-shoulder device with a conventional recumbent bicycle to allow individual and/or simultaneous physical workout of a user's legs, arms, shoulders, abdominal and back.

Physical fitness has become increasingly popular over the years. This is evidenced by the explosive growth of the health fitness industry and the rapid emergence and increasing popularity of health fitness centers throughout the nation. The primary reason for joining these fitness centers is that they provide a number of exercise apparatus which are each specially designed to exercise specific parts of a human anatomy.

However, membership costs for joining these fitness centers can be quite expensive. Such costs are not only substantial but typically recurring for each yearly renewal membership. Further, such fitness centers are typically inconvenient due to their remote location to each user. As such, many users find the commercial fitness centers to be too expensive and too inconvenient to use which have detracted from the overall widespread acceptance.

For these and other reasons, many fitness seekers have turned away from the commercial fitness and opted to purchase various personal exercise apparatus such as stationary bicycles, free-weights, leg or thigh exercisers and the like for use at their homes. Although more convenient to use, such home exercise apparatus pose different deficiencies which significantly detract from their overall utility.

For instance, as with commercial equipment most home use exercise apparatus is typically configured to exercise just one specific part, or at best one related section, of the human anatomy. Therefor, various exercise apparatus must be purchased for a full and complete body workout which can be very costly.

Further, such home exercise apparatus typically take up too much physical space in the home, with users having to allocate a large amount of space in their homes for their proper use.

Moreover, the amount of time that each apparatus consumes to exercise one specific part or related section of their bodies can be substantial, resulting in an overly prolonged exercise time which may become very burdensome.

In view of the above-described shortcomings of conventional exercise apparatus, there exists a need in the art for an exercise apparatus that can optimally provide essential body workouts of multiple muscle groups without the requirement of purchasing and accommodating a wide range of exercise apparatus. More specifically, there exists a need in the art for an exercise apparatus which can achieve such objective in a time-efficient and user-friendly manner so as to encourage, rather than discourage, its users to maintain their regular exercise routines and achieve their optimal physical fitness level.

BRIEF SUMMARY OF THE INVENTION

The present invention specifically addresses and alleviates the above-referenced deficiencies associated with the use of the exercise apparatus of the prior art. In particular, the present invention comprises a multi-functional exercise apparatus which uniquely exercises the upper body, back and abdominal muscle groups of a user. More particularly, the exercise apparatus of the present invention specifically integrates the use of a multi-pivotal upper body assembly and a rotational arm-shoulder device which may be attached to and utilized with a conventional stationary bicycle (e.g., recumbent bicycle). As will be demonstrated below, the present exercise apparatus's adaptability to combine such individual parts into one multi-functional exercise apparatus allows its users to individually and/or simultaneously exercise their legs, arms, shoulders and trunk (i.e., abdominal and back), hence drastically reducing their overall exercise time as well as minimizing physical space requirements. Although adapted for in home use, those skilled in the art will recognize that the present invention is equally adapted for use in commercial fitness centers and the like.

In accordance with a preferred embodiment of the present invention, there is provided a multi-functional exercise apparatus for allowing individual and/or simultaneous workout of a user's legs, arms, shoulders and trunk. The exercise apparatus of the present invention may include a stationary bicycle such as a recumbent bicycle which essentially constitutes a support or foundation of the present invention. As is commonly known in the art, a typical stationary bicycle includes two foot pedals which a user can pedal to obtain a cardiovascular and leg muscle group workout. As is further known in the art, such bicycle includes a seat which is typically supported upon a seat mount or saddle designed to slide back and forth with respect to the foot pedals in order to provide leg adjustment to the user. This description of the typical stationary bicycle is only exemplary in nature and it should be recognized herein that its structural configuration may vary somewhat as there are multiple versions of stationary bicycles currently available in the marketplace.

In the preferred embodiment of the present invention, the multi-functional exercise apparatus features an upper body assembly intended for exercising a user's trunk (i.e., abdominal and back). Specifically, the upper body assembly is preferably formed from three essential components, namely, a base body member, a main body member and an extension body member. The base body member is preferably placed and engaged to the seat mount of the stationary bicycle (e.g., recumbent bicycle) behind the seat thereof. The base body member may be formed of various shapes and configurations as its primary purpose is to movably attach the lower main portion of the main body member. As will be discussed below, a resistive hinged connection or a bearing arrangement may be defined therebetween to allow the main body member to move in various directions relative to the base body member.

The main body member extends generally upwardly from the base body member. Preferably, the main body member is positioned such that its centerline is close to the user's head, and more particularly to an imaginary axis which extends centrally and vertically through the head and spine of the exerciser's body. As such, the lower main portion is preferably aligned in a generally parallel relation to the exerciser's imaginary central axis. Such alignment position of the main body member should always be maintained irrespective of the seat mount's adjustment with respect to the bicycle's rotatable foot pedals.

In use, a user can move the main body member against the resistive biasing force to exercise the user's abdomens and trunk. In one embodiment, the lower main portion may be resiliently engaged to the base body member in a hinged manner so that the exerciser is allowed to pivot the main body member laterally about a side-to-side arcuate pathway (i.e., side to side movement with respect to the exerciser's axis of center).

In an alternate embodiment, the resiliently engaged main body member may be operatively transitional between a number of different pathways through utilizing a resistive bearing arrangement such as a multi-pivot torsional spring in cooperation with the base body member. Through forming such multi-pivotal connection, the main body member can be pivoted along a side-to-side pathway as explained above, a forward-to-backward pathway (i.e., forward to backward movement with respect to the exerciser's axis of center) and/or a rotational pathway (i.e., rotational movement with respect to the exerciser's axis of center). By possessing this capability to move in such multiple pathways, the upper body assembly is configured to provide optimal trunk workout to its exerciser.

An extension body member is engaged to the main body member and substantially extends in a forward direction across and over the seat mount and seat of the stationary bicycle. In the preferred embodiment, an upper extension portion of the extension body member is slidably inserted through an upper main aperture formed at the upper main portion. In this regard, the extension body member may be variably axially adjusted with respect to the main body member and a retaining component such as a removable stop pin may be used to fix the extension body member in the desired adjusted position. As will be explained later, this allows the rotational arm-shoulder device which is located at the opposite end of the extension body member to be provided at a desired distance from the user.

The extension body member is substantially advanced forward towards the rotating foot pedals of the stationary bicycle and then curved downward to define a lower extension end. The purpose of the lower extension end is to mount the arm-shoulder device such that it may be manually rotated by the exerciser. Although the arm-shoulder device may be formed having differing structure, it is preferably formed having a fly wheel or a hand crank assembly.

In the present invention, a resistive assembly is preferably provided with the arm-shoulder device so as to produce a variable resistive force against the rotational movement thereof. Such resistive force may be provided via various structures. For example, a brake shoe may be mechanically applied upon the arm-shoulder device in order to provide variable resistance thereto. It is contemplated herein that various types of resistive assemblies such as frictional and/or magnetic brakes, or even ones that resort to electronic means for resistance, may be used in lieu thereof. For abdominal and back exercise, the exercise apparatus of the present invention may be mechanically connected (via a cable, for example) to different weight sets to acquire variable resistance therefrom in addition to, or instead of, relying on the resilient pivot connections of the apparatus as defined above.

In accordance with an alternately preferred embodiment of the present invention, a multi-functional exercise apparatus of modified structure is disclosed herein. This specific exercise apparatus is essentially designed to perform the same function as that of the above-described exercise apparatus through the use of a modified structural configuration. As will be demonstrated immediately below, it defines multiple locations of pivotal movement all directed toward optimally working out the abdominal and back of the exerciser.

In lieu of utilizing one generalized location of pivotal movement, the alternately configured exercise apparatus comprises two locations of pivotal movement, of which one location is intended for performing forward and back trunk exercise, while the other is geared toward conducting twist trunk exercise. The first pivotally moving location is defined adjacent the lower end of the upper body assembly between its base and main body members. More specifically, the main body member is connected to the stationary base body member in a manner as to be pivotally movable with respect thereto about a horizontal pivot axis. Such pivoting action can be effectuated through the exerciser's exertion of force upon the arm-shoulder device in the forward direction which causes the main body member to pivot relative to the base body member about the horizontal pivot axis.

The second pivotally moving location is defined adjacent the upper end of the upper body assembly between the main and connection body members. More particularly, a pivot connection cam is formed adjacent the upper main portion of the main body member whereat the connection body member is pivotally attached thereto and further extended in the forward direction therefrom. By applying such connection cam therebetween, the connection body member is allowed to pivot relative to the main body member about the vertical pivot axis when the exerciser moves the arm-shoulder device side to side with his or her hands. Optionally, the connection body member may be spring mounted to the pivot connection cam so as to be always resiliently urged back to center to its natural rested position. By doing so, the exerciser can repetitively twist his or her trunk in the corresponding directions and optimally exercise the side portions of the abdominal.

The alternative version of the exercise apparatus may merely resort to the resiliency of the pivot attachments to obtain the required resistance as described in the first embodied exercise apparatus. However, in this alternative version, it is preferred that a mechanical attachment to one or more weights is used for providing the requisite resistance to the forward and twist trunk exercise. Such mechanical attachment may be made by running a cable or cord along the outer perimeter of the pivot connection cam to a generally backward extended roller which in turn directs the cable or cord to the weight(s). This arrangement provides the leverage necessary to raise the weights when performing the forward and/or twist exercise of the exerciser's trunk. Of course, the weights may be selectively used to vary the resistance of the trunk exercise.

In operation, the multi-functional exercise apparatus as depicted in all embodiments of the present invention is adapted to individually and/or simultaneously exercise the legs, arms, shoulders and trunk (i.e., abdominal and back) of a user. To perform such complete body workout at the same time, the exerciser should be first seated upon the seat of the stationary bicycle (e.g., recumbent bicycle). The user can then grasp the hand-crank assembly of the rotational arm-shoulder device. Further, the user may position his or her feet upon the foot pedals of the exercise bicycle.

Upon being positioned in this fashion, the user can begin pedaling the foot pedals of the bicycle so as to exercise his or her legs. During such pedaling, the user can also manually rotate the arm-shoulder device through the use of the crank assembly to exercise the user's arm and shoulder muscle groups. Moreover, the user may further pivot the upper body assembly in a plurality of pathways to exercise the user's trunk, that is, the abdominal and the back muscle groups. In this respect, the multi-functional exercise apparatus of the present invention allows the user to individually and/or simultaneously exercise the user's legs, arms, shoulders, abdominal and back so as to drastically reduce the overall exercise time. Of course, the exerciser can optionally operate different parts of the present exercise apparatus individually as opposed to simultaneously.

BRIEF DESCRIPTION OF THE DRAWINGS

These as well as other features of the present invention will become more apparent upon reference to the drawings wherein.

DETAILED DESCRIPTION OF THE INVENTION

Figure 1:
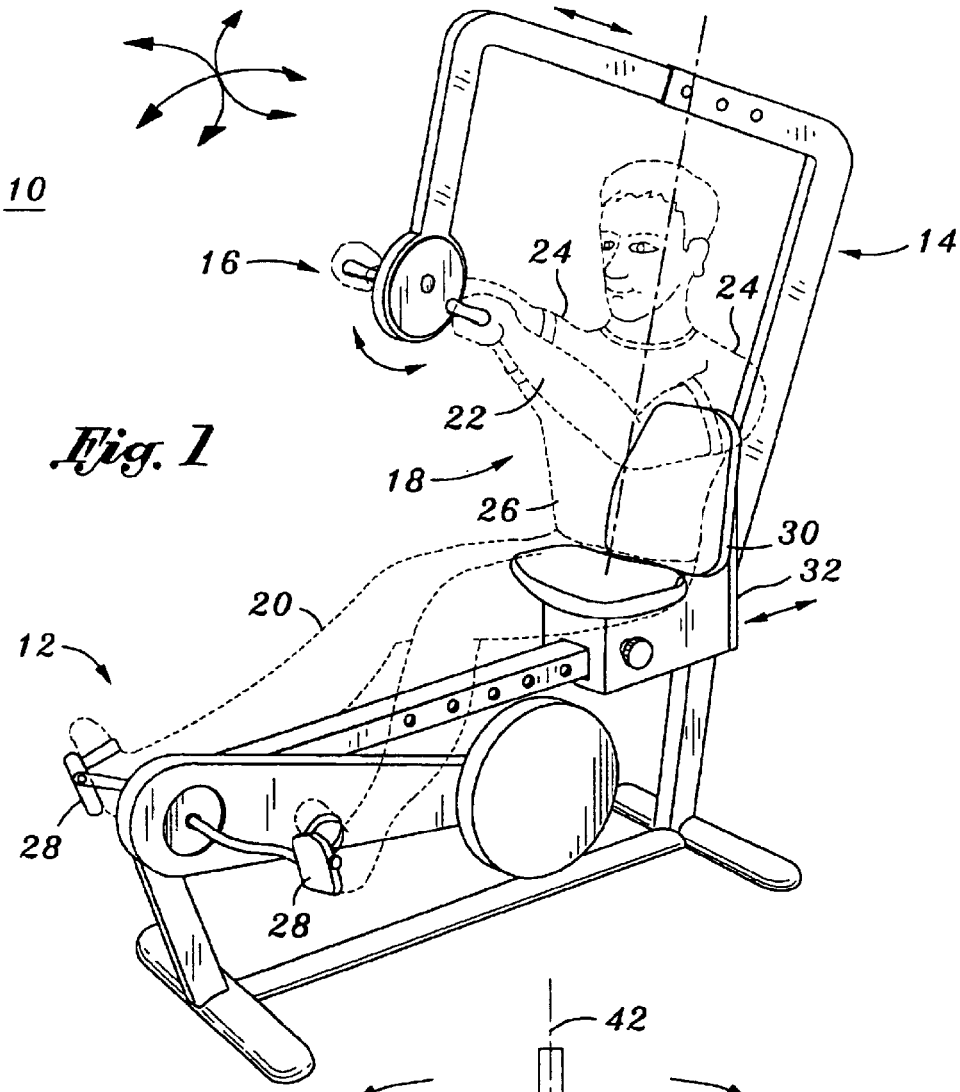
FIG. 1 is a perspective view of a multi-functional exercise apparatus constructed in accordance with a preferred embodiment of the present invention and illustrating its multi-pivotal upper body assembly which is extended over a stationary bicycle such as a recumbent bicycle.

Referring now to the drawings wherein the showings are for purposes of illustrating preferred embodiments of the present invention only, and not for purposes of limiting the same, FIG. 1 prospectively illustrates the multi-functional exercise apparatus 10 constructed in accordance with a preferred embodiment of the present invention.

As will be described shortly below, the exercise apparatus 10 of the present invention specifically integrates the use of a multi-pivotal upper body assembly 14 and a rotational arm-shoulder device 16 which may be preferably moved to the conventional stationary bicycle 12 (e.g., recumbent bicycle). Although preferable, the multi-pivotal upper body assembly 14 and rotational arm-shoulder device 16 need not be mounted to the stationary bicycle 12 but can be supported upon a stationary stand or wall mount (not shown). Such combination of individual parts into a single multi-functional exercise apparatus 10 allows a user 18 to individually and/or simultaneously exercise the legs 20, arms 22, shoulders 24 and trunk 26 (i.e., abdominal and back).

Figure 3:
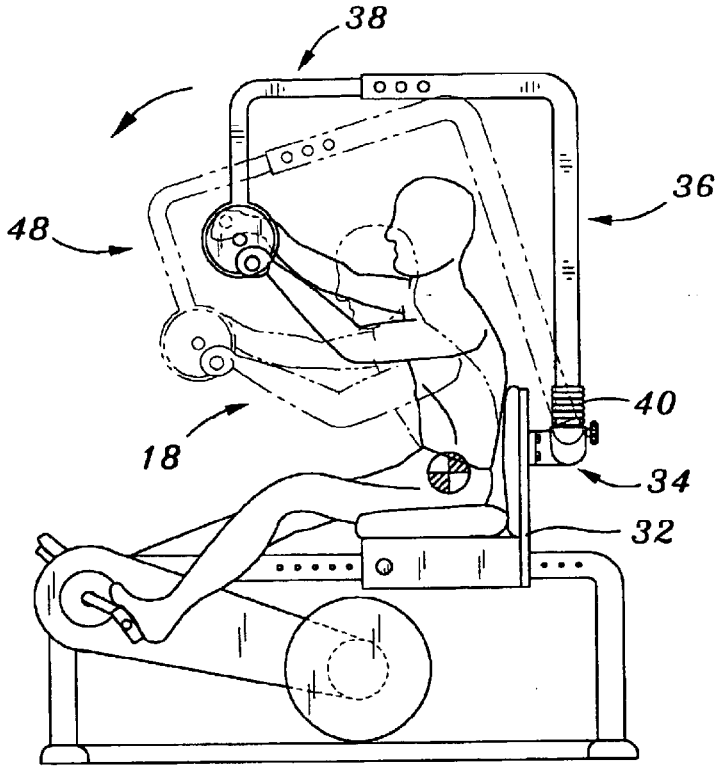
FIG. 3 is a side elevational view of the multi-pivotal upper body assembly shown in FIG. 1 illustrating its forward pivotal exercise movement.
Figure 4:
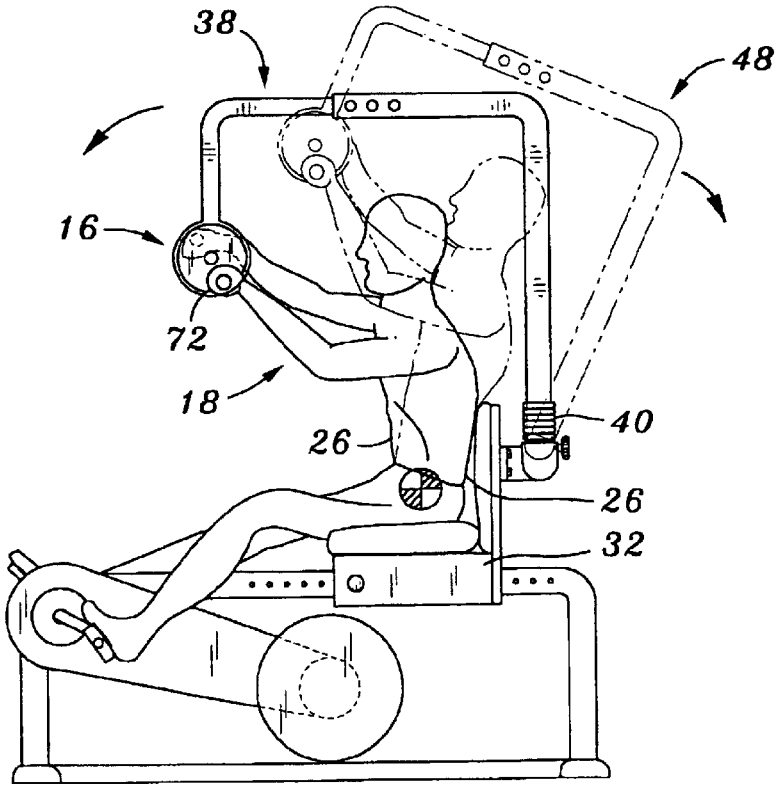
FIG. 4 is a side elevational view of the multi-pivotal upper body assembly shown in FIG. 1 illustrating its backward pivotal exercise movement.

Referring more particularly to FIGS. 1, 3 and 4, the multi-functional exercise apparatus 10 of the present invention preferably includes a conventional stationary bicycle 12 such as a recumbent bicycle, which essentially serves as a base or foundation of the present invention. As is commonly known in the art, the stationary bicycle 12 includes two rotating foot pedals 28 in which a user 18 can pedal to obtain cardiovascular and leg muscle exercise. As is further known in the art, such bicycle 12 also includes a seat 30 which is typically supported upon a seat mount or saddle 32 that can slide back and forth with respect to the rotating foot pedals 28 in order to provide necessary adjustment for the user 18.

Figure 5:
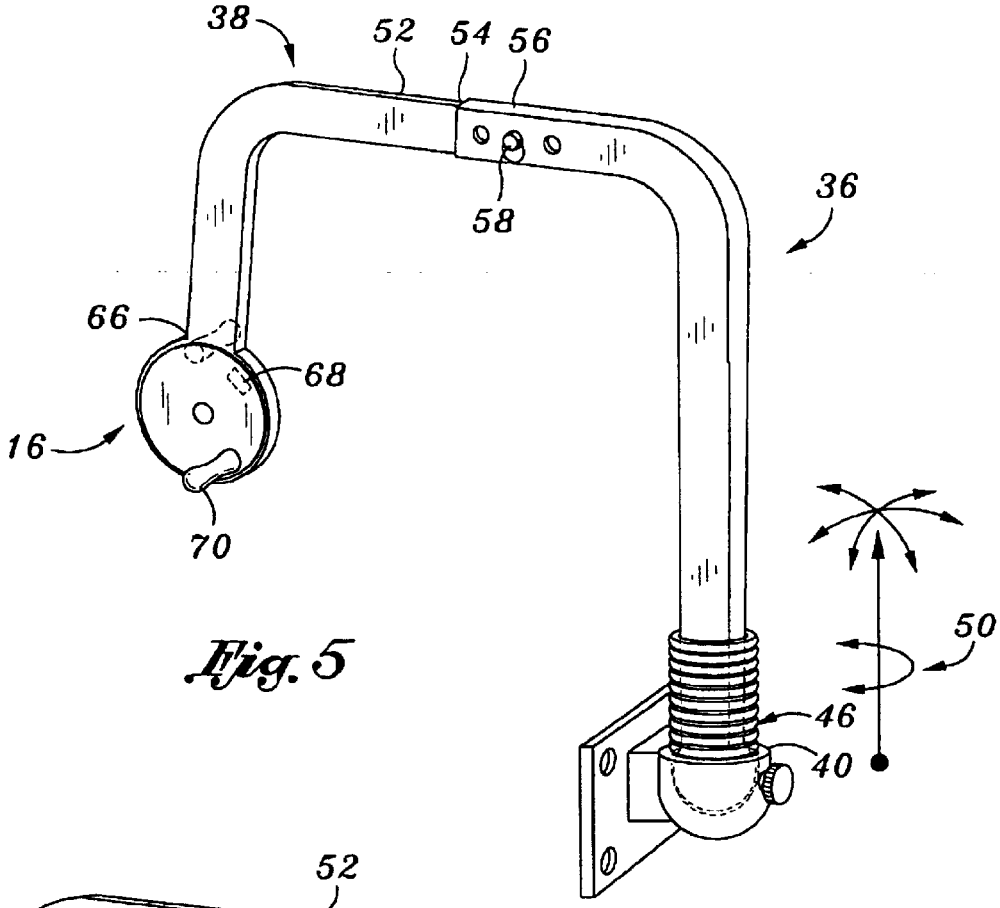
FIG. 5 is a perspective view of the multi-pivotal upper body assembly shown in FIG. 1 illustrating its hand crank assembly which serves as a rotational arm-shoulder exercise device of the present exercise apparatus.
Figure 6:
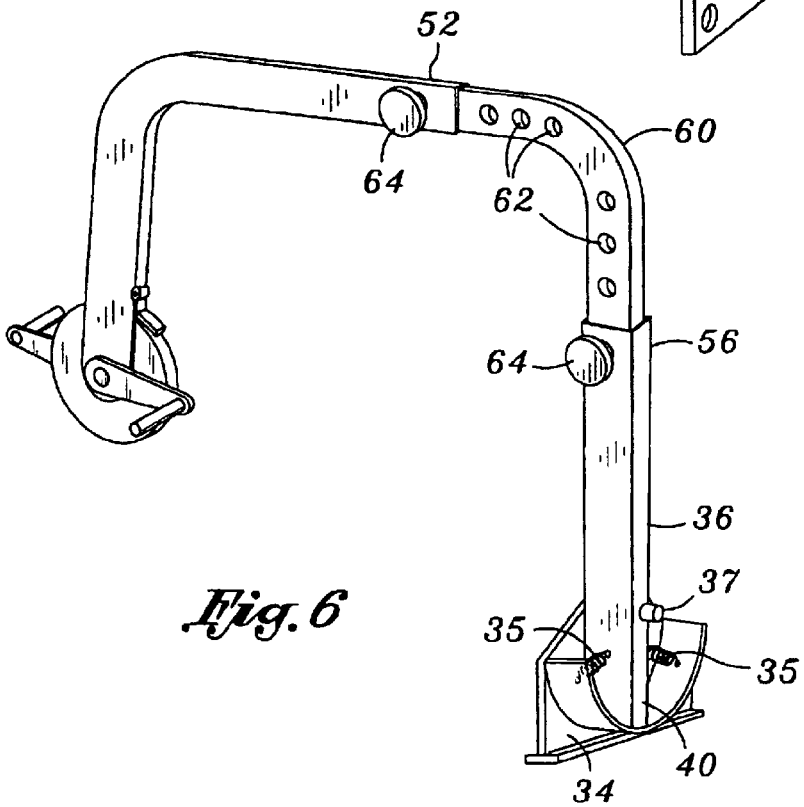
FIG. 6 is a perspective view of an alternately configured upper body assembly illustrating a fly wheel engaged thereto which serves as a rotational arm-shoulder exercise device and illustrating an additional resistive connection for the upper body assembly.

Referring now to FIGS. 5 and 6, the multi-pivotal upper body assembly 14 which is specifically intended for exercising a user's trunk 26 (i.e., abdominal and back) is depicted. In the preferred embodiment, the upper body assembly 14 is formed from three components, namely, a base body member 34, a main body member 36 and an extension body member 38. The base body member 34 is preferably placed and mounted to the seat mount 32 of the stationary bicycle 12 (e.g., recumbent bicycle) behind the seat 30 thereof. The base body member 34 may be formed of various configurations as its primary purpose is to mount the main body member 36 at its lower main portion 40. In this respect, the generally rounded or trapezoidal shape of the base body member 34 is only an exemplary depiction, and thus should not be limited thereto. As will be discussed shortly, a pivot/hinged connection (best shown in FIG. 6) or a pivoting bearing arrangement (best shown in FIG. 5) may be provided between the main body member 36 and the base body member 34 in order to allow the main body member 36 to resistively move in various directions relative to the base body member 34.

The main body member 36 extends upwardly from the base body member 34. Preferably, the main body member 36 is positioned such that its vertical centerline is as close to the imaginary centerline extending through the user's head and spine. In this position, the lower main portion 40 of the main body member 36 should preferably be disposed, although not mandatory, in a generally parallel relation to the exerciser's central axis. A resistive biasing assembly is provided between the main body member 36 and the base body member 34 such as opposing springs or a torsional/coil spring to cause the main body member 36 to return back to the above-defined position after it be moved therefrom during exercise by the user.

Figure 2:
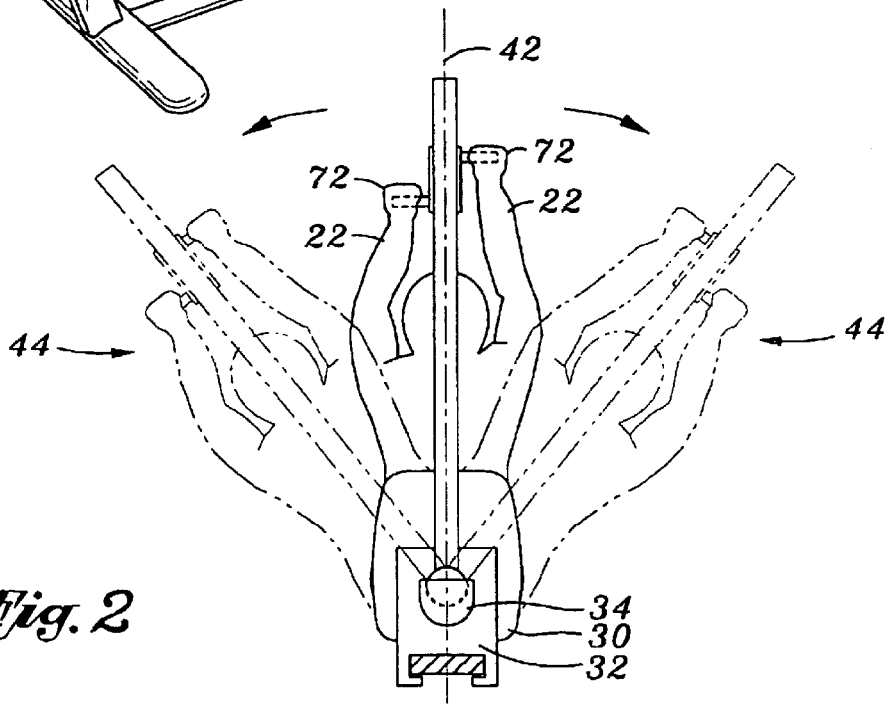
FIG. 2 is a rear plan view of the multi-pivotal upper body assembly shown in FIG. 1 illustrating its side to side pivotal exercise movement.

Referring to FIGS. 2 and 6 only, the upper body member 36 is pivotly mounted to the base body member 34 by a pivot pin 37. A pair of coil springs 35 may be provided on opposite sides of the body members 36 and 34 to provide a resistive pivot force about the pin 37 such that the user 18 may move the main body member 36 against the resistive spring biasing force to exercise the user's trunk 26. This allows the main body member 36 to be pivoted about the axis of the pivot pin 37 along a side-to-side pathway 44 (shown in FIG. 2).

Referring specifically now to FIGS. 2–5, the resiliently engaged main body member 36 may alternatively be mounted to the base body member 34 via a torsional coil spring 39 which provides resistive bending and/or torsional/twisting movement between the upper and base body members to enable transitional exercise movement between a number of different pathways (best shown in FIG. 5). Through forming such multi-pivotal connection, the main body member 36 can additionally be pivoted along a side-to-side pathway 44 as explained above. However, the main body member 36 may also be pivoted along a forward-to-backward pathway 48 (best shown in FIGS. 3 and 4). Moreover, the main body member 36 may further be pivoted along a rotational or twisting pathway 50, the movement of which is exemplified in FIG. 5.

As shown in FIGS. 1, 5 and 6, the extension body member 38 is mounted to the main body member 36 and extends in a forward direction over the seat mount 32 and seat 30 of the stationary bicycle 12. Preferably, an upper extension portion 52 of the extension body member 38 is slidably inserted through an upper main aperture 54 formed at the upper main portion 56 of the main body member 36. By forming such configuration, the extension body member 38 may be selectively telescopingly adjusted with respect to the main body member 36 whereby a retaining component 58 such as a removable stop pin can be used to fix the extension body member 38 at a desirable adjusted position (shown in FIG. 5). As will be further explained later, this allows the rotational arm-shoulder device 16 which is located at the opposite end of the extension body member 38 to be selectively positioned at a desired axial distance from the seated user 18. It is contemplated herein, however, that the use of the extension body member 38 is merely preferred, but not mandatory.

Likewise, the upper body assembly 14 may be configured to be vertically adjustable so as to accommodate various heights of the exercisers 18. One configuration of the upper body assembly 14 which allows for such vertical height adjustment is illustrated in FIG. 6. As shown, a connection body member 60 may be slidably placed within and between the main body member 36 and the extension body member 38. The connection body member 60 may include a number of fastening holes 62 at locations next to the main body member 36 and the extension body member 38. In this regard, the connection body member 60 may be vertically adjusted with respect to the main body member 36 whereby a fastener pin 64 is inserted therethrough and into the selected hole 62 to fix those two body members 36, 60 in position (shown in FIG. 6). Further, horizontal adjustment between the extension body member 38 and the connection body member 60 may be accomplished in the similar manner. In this respect, the upper body assembly 14 may be vertically and horizontally adjusted in a convenient and user-friendly manner to be consistent with the anatomical relationships of height and arm length of the exerciser 18.

A substantial portion of the extension body member 38 is generally advanced forward toward the rotatable foot pedals 28 of the stationary bicycle 12 and then curved downward to define a lower extension end 66. The lower extension end 66 mounts the arm-shoulder device 16 such that it may be manually rotated about that end 66 by the user 18 (shown in FIG. 1). There are multiple ways for accommodating the arm-shoulder device 16. For one, the arm-shoulder device 16 may be merely attached at or near the lower extension end 66 through the use of a fastening pin, for example, so that it can be freely rotated thereabout.

In the alternative, however, the lower extension end 66 may be shaped in such a configuration as to provide an opening in which the arm-shoulder device 16 may be fitted and be freely rotatable therein. As such, the opening resulting from such configuration of the lower extension end 66 should substantially correspond to the shape of the rotational arm-shoulder device 16. Although the arm-shoulder device 16 may be variously formed, it is preferably a hand crank fly wheel (best shown in FIG. 6) or a crank assembly (best shown in FIG. 5) generally defining a circular configuration.

In the preferred embodiment, a resistor assembly 68 is provided with the arm-shoulder device 16 so as to produce a variable resistive force against the rotational movement thereof. The purpose of this is to optimize the arm exercise by increasing the amount of force that the exerciser's arms 22 are subjected to. Such resistive force may be arranged through various forms and types of resistor assemblies 68. For example, a brake shoe or galloper brake may be applied upon the arm-shoulder device 16 in order to provide variable resistance thereto. However, it should be contemplated herein that various types of resistive assemblies such as frictional and/or magnetic brakes, or even ones that resort to electronic means for resistance, may be used in lieu thereof. It is simply the concept of applying a variable resistive force upon the arm-shoulder device 16 that should be appreciated.

Referring now to FIGS. 5 and 6 only, a pair of hand-graspable member 70 are outwardly extended on opposing sides of the arm-shoulder device 16 so as to accommodate each hand 72 of the user 18. Through the use of the hand-graspable members 70, the manual rotation of the arm-shoulder device 16 can be facilitated to exercising the arms 22 of the exerciser 18.

Figure 7:
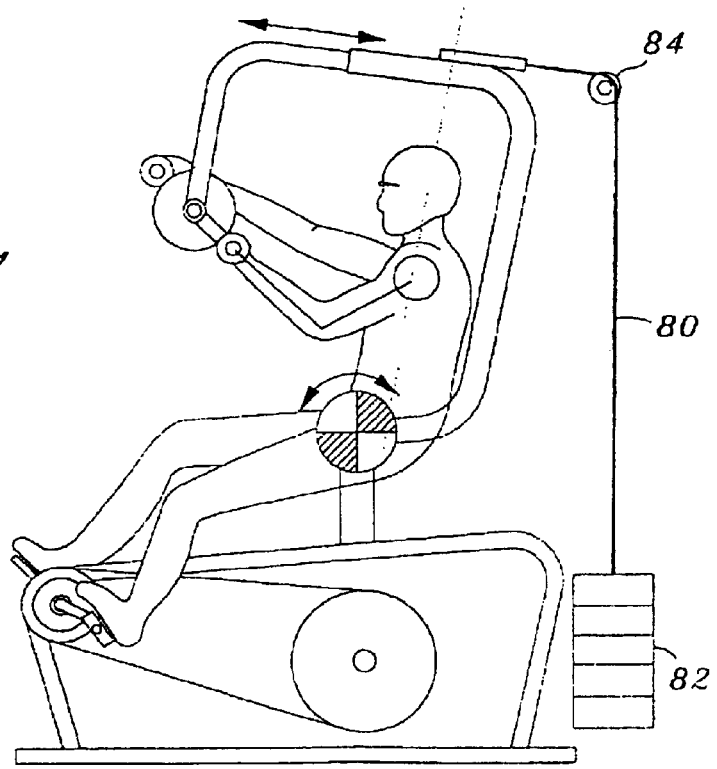
FIG. 7 is a side view of the multi-functional exercise apparatus shown in FIG. 1 and illustrating its mechanical connection to a plurality of weights via a cord for providing a variable resistance to a user when performing an abdominal and back exercise.

As shown in FIG. 7, the multi-functional exercise apparatus 10 of the present invention may portray a slight structural modification to its design for conducting abdominal and back exercise. More specifically, a cable or cord 80 leading to a plurality of weights 82 may be placed in connection with the modified version of the exercise apparatus 10 through the use of one or more rollers 84 selectively provided thereat. It should be noted that such mechanical connection enables the weights 82 to provide additional resistance to the trunk 26 (i.e. abdominal and back) of the exerciser 18 during its exercise, or alternatively be used as a sole means of resistance when the relevant pivot connections as defined above are not characterized by any resiliency. Of course, different number of and/or scaled weights 82 may be utilized to selectively vary the resistance applied upon the trunk 26 of the exerciser 18.

Figure 8:
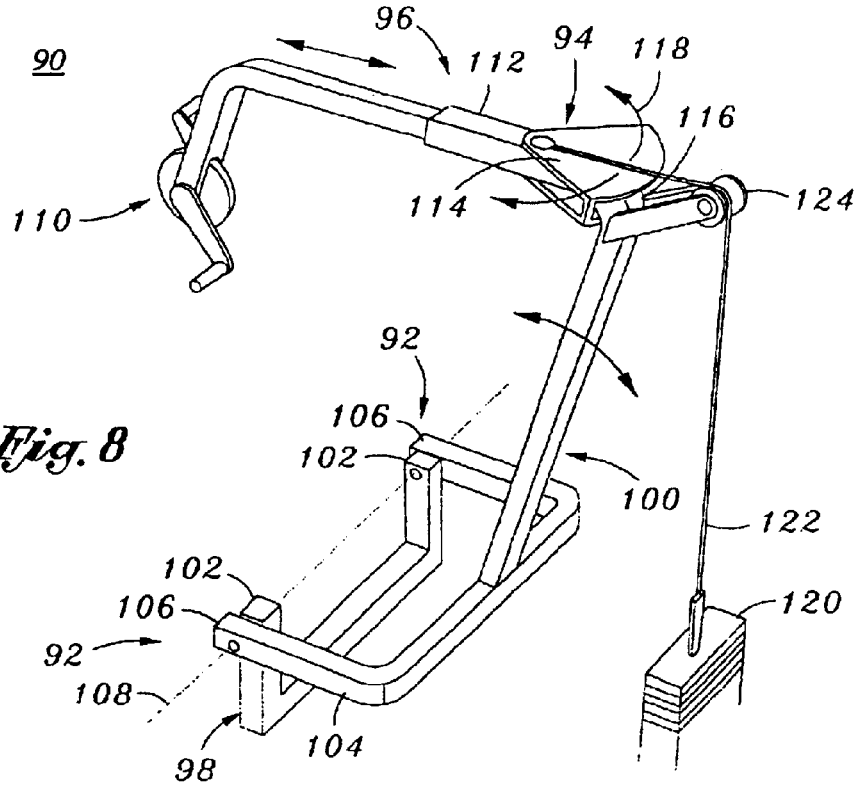
FIG. 8 is a perspective view of a multi-functional exercise apparatus constructed in accordance with an alternately preferred embodiment of the present invention and illustrating various pivot connections which are located at different points of structure than the exercise apparatus shown in FIG. 1.

Referring now to FIG. 8, there is shown a multi-functional exercise apparatus 90 which is constructed in accordance with an alternately preferred embodiment of the present invention. The alternately embodied exercise apparatus 90 is essentially designed to perform the same function as that of the above-described exercise apparatus 10, that is, to individually and/or simultaneously exercise the legs 20, arms 22, shoulders 24 and trunk 26 (i.e., abdominal and back) of the exerciser 18. However, although the structural components for exercising the legs 20, arms 22 and shoulders 24 may be identical to what has been disclosed above, the counterpart version for exercising the trunk is structurally different therefrom.

In particular, the multi-functional exercise apparatus 90 of the alternate embodiment defines multiple locations for pivotal movement which are collectively directed to working out the abdominal and back of the exerciser. More particularly, such apparatus 90 includes two locations for pivotal movement as opposed to one generalized location therefor as characterized in the exercise apparatus 10 embodied above. One pivoting location 92 is for performing forward and back trunk exercise, while the other pivoting location 94 is for conducting twist trunk exercise.

In order to allow the forward and back trunk exercise, the first pivotally moving location 92 is defined about the lower end of the upper body assembly 96 where its base body member 98 and main body member 100 are connected to each other. Similar to the above-embodied exercise apparatus 10, the base body member 98 of this configuration is adapted to be stationarily or fixedly attached to a seat mount or saddle 32 of a stationary bicycle 12 such as a recumbent bicycle. Although it may be formed of various shapes and materials, the base body member 98 utilized in this embodiment is preferably made of metal and is configured in a U-like shape which extends two exposed base ends 102 in an upward direction.

The main body member 100 is connected to the two exposed base ends 102 through its lower main portion 104 which defines a substantially corresponding shape to the base body member 98. Likewise, the main body member 100 is also fabricated from a metallic material. Because of their corresponding shapes, the main body member 100 can engage the base body member 98 by connecting its two complimentary exposed main ends 106 to the two base ends 102. However, it should be noted herein that such connection between the ends 102, 106 is accomplished in a manner as to allow the lower main portion 104 to pivot with respect to the base body member 98 about a horizontal pivot axis 108. Such pivoting action can be effectuated through the exerciser's exertion of force upon the arm-shoulder device 110 in the forward direction which in turn causes the main body member 100 to pivot relative to the base body member 98 about the horizontal pivot axis 108.

The second pivotally moving location 94 is defined about the upper end of the upper body assembly 96 where its main body member 100 and connection body member 112 are pivotally connected to each other. More particularly, a pivot connection cam 114 is provided adjacent an upper main portion 116 of the main body member 100. Although the pivot connection cam 114 may be formed of different materials and shapes, it is preferably constructed of metal and defines an elliptical or semi-round shape. This cam 114 is used to pivotally attach the connection body member 112 which extends in the forward direction therefrom away from the upper main portion 116. By utilizing such connection cam 114, the connection body member 112 can pivot with respect to the upper main portion 116 about a vertical pivot axis 118 when the exerciser moves the arm-shoulder device 110 side to side with his or her hands 72. By doing so, the exerciser can repetitively twist his or her trunk in the corresponding directions and optimally exercise the side portions of the abdominal.

Optionally, the connection body member 112 may be spring mounted to the pivot connection cam 114 so as to be always resiliently urged back to center to its natural rested position. This, of course, may provide the resistance necessary to adequately conduct the twist trunk exercise.

Although the exercise apparatus 90 may resort to the resiliency of its pivot attachments 92, 94 to obtain the required resistance therefrom, it is preferably mechanically connected to one or more weights 120 instead. The weights 120 can be selectively set together to provide varying degrees of resistance to the exerciser 18 during his or her abdominal and back exercise. The exercise apparatus 90 may be connected to the weights 120 through utilizing a cable or cord 122 along the outer perimeter 124 of the pivot connection cam 114. This cable or cord 122 would then lead to a backward extended roller 124 to be directed to the weights 120. This provides the leverage necessary to raise the weights 120 when performing the forward-to-back and/or twist exercise of the exerciser's trunk 26.

Similar to the exercise apparatus 10 of the first embodiment, the arm-shoulder device 110 of the second embodied exercise apparatus 90 may be horizontally adjusted relative to the connection body member 112 so as yield an optimal arm-length distance to the exerciser 18. Furthermore, it is expressly contemplated herein that the upper body assembly 96 of the second embodied exercise apparatus 90 may be altered in design to be vertically adjustable to satisfy the differing heights of its exercisers 18. By doing so, the exercise apparatus 90 of the second embodiment may also be conformed to be consistent with the anatomical relationships of height and arm length of the exerciser 18.

With the structure defined, the operation of the multi-functional exercise apparatus 10 of the first embodiment is described herein to essentially illustrate the operation of the exercise apparatus 90 of the second embodiment as well. The exercise apparatus 10 of the first embodiment is adapted to individually and/or simultaneously exercise the legs 20, arms 22, shoulders 24 and trunk 26 (i.e., abdominal and back) of the exerciser 18. To perform such complete a body workout at the same time, the exerciser 18 should first be seated upon the seat 30 of the stationary bicycle 12 (e.g., recumbent bicycle). Upon such seating, the user 18 can then grab the hand-graspable members 70 of the rotational arm-shoulder device 16. Similarly, the user may place the user's feet upon the foot crank pedals of the stationary bicycle.

Upon being positioned in this fashion, the user 18 is now ready to begin an individual and/or simultaneous exercise workout. The user 18 can begin pedaling the foot pedals 28 of the stationary bicycle 12 so as to exercise his or her legs 20. During such pedaling, the user can also manually rotate the arm-shoulder device 16 through the use of the hand-graspable members 70 for an arm and shoulder workout. Moreover, the user 18 may further pivot the upper body assembly 14 in a plurality of pathways to exercise his or her trunk 26, that is, the abdominal and the back muscle groups. In this respect, the multi-functional exercise apparatus 10 of the present invention allows the user 18 to independently and/or simultaneously work out his or her legs 20, arms 22, shoulders 24 and trunk 26 (i.e., abdominal and back) so as to drastically reduce the overall exercise time. Of course, the user 18 can optionally operate different parts of the present exercise apparatus 10 separately as opposed to simultaneously.

Additional modifications and improvements of the present invention may also be apparent to those of ordinary skill in the art. Thus, the particular combination of parts described and illustrated herein is intended to represent only certain embodiments of the present invention, and is not intended to serve as limitations of alternative devices within the spirit and scope of the invention.

What is claimed is:

1. A multifunctional exercise apparatus for exercising legs, arms, shoulders and a trunk of an exerciser, the exercise apparatus comprising:

a stationary recumbent bicycle having a frame including a beam that is disposed horizontally above a support surface;

a seat mount movably mounted to the beam such that the seat mount can be adjustably displaced longitudinally along the beam;

a seat portion mounted to the seat mount;

a pair of cranks rotatably mounted to the frame and a pedal pivotally coupled to each crank;

an upper body assembly movably mounted to the seat mount and extending upwardly and forward from the seat mount; and an arm-shoulder device movably coupled to the upper body assembly;

wherein the exerciser is accommodated upon the seat mount to move the upper body assembly with respect to the seat mount for exercising the trunk while moving the arm-shoulder device with respect to the upper body assembly for exercising the arms and shoulders.

2. A multifunctional exercise apparatus for exercising legs, arms, shoulders and a trunk of an exerciser, the exercise apparatus comprising:

a stationary recumbent bicycle having a frame including a beam that is disposed horizontally above a support surface;

a seat mount attached to the beam;

a seat portion mounted to the seat mount;

a pair of cranks rotatably mounted to the frame and a pedal pivotally coupled to each crank;

an upper body assembly movably mounted to the seat mount and extending upwardly and forward from the seat mount; the upper body assembly having a main body member and a base body member, the main body member having a lower main portion, the lower main portion being engaged to the base body member, the base body member being engaged to the seat mount;

at least one weight placed in communication with the main body member, the weight being sized and configured to provide a resistive force upon the main body member with the upper body assembly being moveable against the resistive force; and an arm-shoulder device movably coupled to the upper body assembly;

wherein the exerciser is accommodated upon the seat mount to move the upper body assembly with respect to the seat mount for exercising the trunk while moving the arm-shoulder device with respect to the upper body assembly for exercising the arms and shoulders.

3. A multifunctional exercise apparatus for exercising legs, arms and shoulders of an exerciser, the exercise apparatus comprising:

a stationary bicycle having a frame including a beam that is disposed horizontally above a support surface;

a seat mount movably mounted to the beam such that the seat mount can be can be adjustably displaced longitudinally along the beam;

a seat portion mounted to the seat mount;

a pair of cranks rotatably mounted to the frame and a pedal pivotally coupled to each crank;

a rotatable arm-shoulder device movably mounted with the seat mount and extending upwardly and forward of the seat mount, the rotatable arm shoulder device being a flywheel assembly; and at least one hand-graspable member outwardly extended from the arm-shoulder device, the hand-graspable member facilitating the rotation of the flywheel;

wherein the exerciser being accommodated upon the seat mount to rotate the pedals for exercising the legs while rotating the arm-shoulder device through use of at least one hand-graspable member for exercising the arms and shoulders.

4. A multifunctional exercise apparatus for exercising legs, arms and shoulders of an exerciser, the exercise apparatus comprising:

a stationary bicycle having a frame including a beam that is disposed horizontally above a support surface;

a seat mount movably mounted to the beam such that the seat mount can be can be adjustably displaced longitudinally along the beam;

a seat portion mounted to the seat mount;

a pair of cranks rotatably mounted to the frame and a pedal pivotally coupled to each crank;

a rotatable arm-shoulder device mounted with the seat mount and extending upwardly and forward of the seat mount, the rotatable arm shoulder device being a crank assembly; and at least one hand-graspable member outwardly extended from the arm-shoulder device, the hand-graspable member facilitating the rotation of the crank assembly;

wherein the exerciser being accommodated upon the seat mount to rotate the pedals for exercising the legs while rotating the arm-shoulder device through use of at least one hand-graspable member for exercising the arms and shoulders.

5. A multifunctional exercise apparatus for exercising legs and a trunk of an exerciser, the exercise apparatus comprising:

a stationary recumbent bicycle having a frame including a beam that is disposed horizontally above a support surface;

a seat mount movably mounted to the beam such that the seat mount can be can be adjustably displaced longitudinally along the beam;

a seat portion mounted to the seat mount;

a pair of cranks rotatably mounted to the frame and a pedal pivotally coupled to each crank;

an upper body assembly movably mounted to the seat mount and extending upwardly and forward of the seat mount, wherein the exerciser is accommodated upon the seat to rotate the pedals for exercising the legs while simultaneously moving the upper body assembly with respect to the seat mount for exercising the trunk.

* * * * *